US009617844B2

(12) United States Patent
Miller

(10) Patent No.: US 9,617,844 B2
(45) Date of Patent: Apr. 11, 2017

(54) SYSTEMS AND METHODS FOR MINIMIZING IMPACT LOADING IN DOWNHOLE TOOLS

(71) Applicant: Halliburton Energy Services, Inc., Houston, TX (US)

(72) Inventor: Todd Blaine Miller, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 375 days.

(21) Appl. No.: 14/365,651

(22) PCT Filed: Jul. 16, 2013

(86) PCT No.: PCT/US2013/050642
§ 371 (c)(1),
(2) Date: Jun. 16, 2014

(87) PCT Pub. No.: WO2015/009283
PCT Pub. Date: Jan. 22, 2015

(65) Prior Publication Data

US 2016/0215609 A1 Jul. 28, 2016

(51) Int. Cl.

| | |
|---|---|
| ***E21B 47/017*** | (2012.01) |
| ***E21B 31/107*** | (2006.01) |
| ***E21B 47/01*** | (2012.01) |
| ***E21B 17/02*** | (2006.01) |
| ***E21B 17/07*** | (2006.01) |

(52) U.S. Cl.
CPC ..... *E21B 47/011* (2013.01); *E21B 17/023* (2013.01); *E21B 17/07* (2013.01); *E21B 31/107* (2013.01)

(58) Field of Classification Search
CPC ..... E21B 17/07; E21B 47/011
See application file for complete search history.

(56) References Cited

U.S. PATENT DOCUMENTS 1,482,845 A * 2/1924 Gallagher ..... E21B 10/32 166/177.7
4,413,516 A * 11/1983 Croom, Jr. ..... E21B 47/011 33/304

(Continued)

FOREIGN PATENT DOCUMENTS

EP 0261291 A1 3/1988
WO 2015009283 A1 1/2015

OTHER PUBLICATIONS

International Search Report and Written Opinion for PCT/US2013/050642 dated Apr. 9, 2014.

*Primary Examiner* — George Gray
(74) *Attorney, Agent, or Firm* — McDermott Will & Emery LLP

(57) ABSTRACT

A tool string includes at least one downhole tool having an electronics package associated therewith, and an air shock tool having a housing operatively coupled to the downhole tool. The air shock tool has a piston movably arranged within a piston chamber defined in the housing, and the electronics package is operatively engaged with the piston such that axial movement of the electronics package correspondingly moves the piston. If a shock impact load propagates through the tool string in an uphole direction, the piston operates to reduce the shock impact assumed by the electronics package.

13 Claims, 3 Drawing Sheets

(56) References Cited

U.S. PATENT DOCUMENTS

| | | | | |
|---|---|---|---|---|
| 4,779,852 | A | 10/1988 | Wassell | |
| 6,412,614 | B1 | 7/2002 | Lagrange et al. | |
| 6,481,495 | B1 * | 11/2002 | Evans | E21B 17/003 166/178 |
| 2009/0095490 | A1 * | 4/2009 | Moriarty | E21B 31/107 166/383 |
| 2011/0186284 | A1 | 8/2011 | Jekielek | |
| 2012/0018142 | A1 | 1/2012 | Spence | |
| 2012/0247832 | A1 * | 10/2012 | Cramer | E21B 47/011 175/40 |
| 2013/0043022 | A1 * | 2/2013 | Forster | E21B 47/18 166/244.1 |

* cited by examiner

SYSTEMS AND METHODS FOR MINIMIZING IMPACT LOADING IN DOWNHOLE TOOLS

BACKGROUND

The present disclosure relates to downhole tools and, in particular, to systems and methods of minimizing shock impacts assumed by electronics arranged within downhole tools.

Hydrocarbons are typically produced from wellbores drilled from the Earth's surface through a variety of producing and non-producing subterranean zones. The wellbore may be drilled substantially vertically or may be drilled as an offset well that has some amount of horizontal displacement from the surface entry point. A variety of servicing operations may be performed in the wellbore after it has been drilled and completed by lowering different kinds of downhole tools into the wellbore. For example, a tool string containing measuring instruments is commonly lowered into the wellbore to obtain various downhole measurements, such as bottom hole pressure and temperature. Various sampling devices are also commonly lowered into the wellbore in the tool string to obtain fluid samples at various target zones of the subterranean formation in order to determine the exact composition of the formation fluids of interest.

Such servicing operations are typically undertaken by lowering the tool string and its various downhole tools into the wellbore on a tension member conveyance, such as wireline or slickline. After the wellbore servicing operation is completed, the downhole tool is withdrawn from the wellbore and the slickline is re-coiled back onto an adjacent wire spool or drum. During its ascent to the surface, the tool string can sometimes become stuck due to differential sticking, key seating, hole sloughing, debris lodged in the wellbore, and other common wellbore conditions. In such situations, the tool string can oftentimes be freed through the application of ordinary tensile or compressive forces delivered from the surface.

In other situations, however, the tool string must be separated from the stuck portions in order to salvage the slickline and prevent costly fishing operations following a slickline cutting operation. This may be done by having a release tool installed in the tool string that may be actuated either at a predetermined time or on command from a well operator at the surface. Upon activating the release tool, the freed portions of the tool string may return to the surface while the stuck portions remain downhole. In order to extract the stuck portions, a jarring tool may be introduced into the wellbore and conveyed to the target location. The jarring tool is designed to provide a high impact jarring force to the tool string in an effort to dislodge the tool from its stuck position.

Actuation of both the separation tool and the jarring tool result in the delivery of a large amount of acceleration that translates into considerable upward rebound forces that may adversely affect internal components of each tool. For example, each tool may include internal electronics that are usually not anchored securely and therefore may be damaged by shock impacts following actuation of either tool. Therefore, it may prove useful to provide a means to minimize shock impacts to internal electronics and electrical components in separation and jarring tools.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to downhole tools and, in particular, to systems and methods of minimizing shock impacts assumed by electronics arranged within downhole tools.

The embodiments described herein provide a means of minimizing shock impacts that may propagate through a tool string upon actuating one or more downhole tools. If not properly minimized such shock impacts may damage electronics packages included in the tool string. In order to minimize the adverse effects of shock impacts, the tool string may include at least one of an air shock tool and an anti-blow up piston. The air shock tool may include a piston movable arranged in a sealed piston chamber and configured as a pneumatic air shock that softens rapid accelerations upon assuming a shock impact. The anti-blowup piston may include a plurality of radially extending fins that engage or otherwise come into close contact with the inner wall of a casing string. Upon assuming a shock impact, the fins are forced into sealing engagement with the inner wall and thereby serve to slow the uphole ascent of the anti-blowup piston.

In some embodiments, the air shock tool and the anti-blow up piston are used together within the tool string. In other embodiments, however, the air shock tool and the anti-blow up piston may be used independently of each other within the tool string. In either case, implementation of such devices within the tool string may prove advantageous in minimizing rapid acceleration of any electronics packages arranged in the interconnected tool string, and thereby lessening adverse effects tied to shock impact loading.

Figure 1:
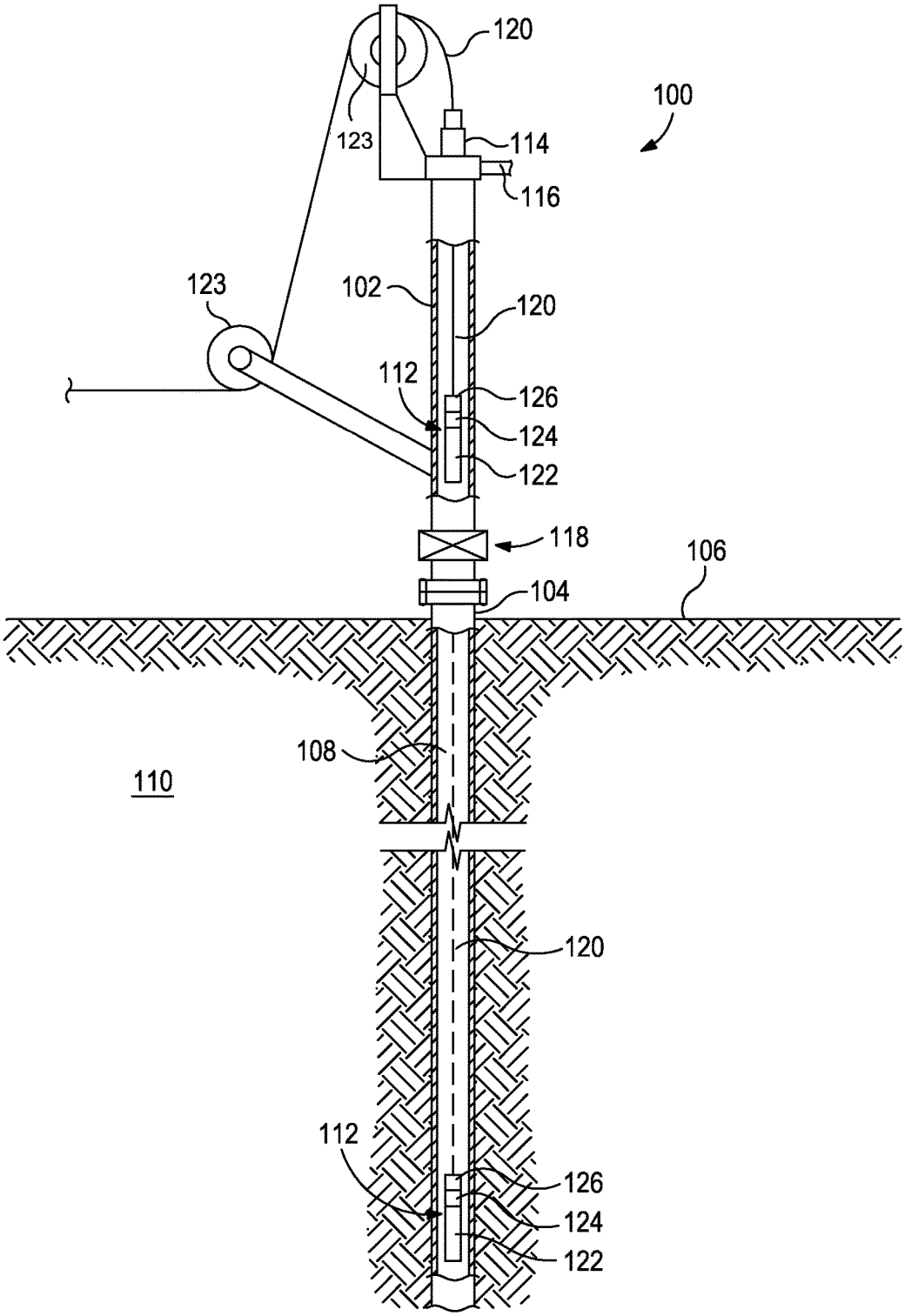
FIG. 1 is a wellbore system that embodies the principles of the present disclosure, according to one or more embodiments.

Referring to FIG. 1, illustrated is an exemplary wellbore system 100 that may embody one or more principles of the present disclosure, according to one or more embodiments. The system 100 may include a lubricator 102 operatively coupled to a wellhead 104 installed at the surface 106 of a wellbore 108. As illustrated, the wellbore 108 extends from the surface 106 and penetrates a subterranean formation 110 for the purpose of recovering hydrocarbons therefrom. While shown as extending vertically from the surface 106 in FIG. 1, it will be appreciated that the wellbore 108 may equally be deviated, horizontal, and/or curved over at least some portions of the wellbore 108, without departing from the scope of the disclosure. The wellbore 108 may be cased, open hole, contain tubing, and/or may generally be characterized as a hole in the ground having a variety of shapes and/or geometries as are known to those of skill in the art. Furthermore, it will be appreciated that embodiments disclosed herein may be employed in surface (e.g., land-based) or subsea wells, without departing from the scope of the disclosure.

The lubricator 102 may be coupled to the wellhead 104 using a variety of known techniques, such as a clamped or bolted connection. Additional components (not shown), such as a tubing head and/or adapter, may be positioned between the lubricator 102 and the wellhead 104. The lubricator 102 may be an elongate, high-pressure pipe or tubular configured to provide a means for introducing a tool string 112 into the wellbore 108 in order to undertake a variety of servicing operations within the wellbore 108. The top of the lubricator 102 may include a stuffing box 114 fluidly coupled to a high-pressure grease-injection line 116 used to introduce grease or another type of sealant into the stuffing box 114 in order to generate a seal. The lower part of the lubricator 102 may include one or more valves 118, such as an isolating valve or swab valve.

The tool string 112 may be attached to the distal end of a wellbore conveyance 120 that is extended into the lubricator 102 via the stuffing box 114. The conveyance 120 may be, but is not limited to, wireline, slickline, electric line (i.e., e-line), jointed tubing, coiled tubing, or the like. The conveyance 120 may be used to transport the tool string 112 into the wellbore 108 such that the desired wellbore servicing operations can be undertaken. The conveyance 120 is generally fed to the lubricator 102 from a spool or drum (not shown) and through one or more sheaves 123 before being introduced into the stuffing box 114 which provides a seal about the conveyance 120 as it slides into the lubricator 102. Those skilled in the art will readily recognize that the arrangement and various components of the lubricator 102 and the wellhead 104 are described merely for illustrative purposes and therefore should not be considered limiting to the present disclosure. Moreover, in sub-sea application the lubricator 102 may be replaced with a wellhead installation, including one or more blowout preventers, without departing from the scope of the disclosure.

The tool string 112 may include a variety of downhole tools used to carry out several unique wellbore operations. In the illustrated embodiment, the tool string 112 may include at least one downhole tool 122, an air shock tool 124, and an anti-blowup piston 126. The downhole tool 122 may include one or more tools configured to deliver or otherwise result in an upward impact force or acceleration being transferred to upper portions of the tool string 112. In some embodiments, for example, the downhole tool 122 may include at least one of a release tool and a jarring tool. For reasons described below, the air shock tool 124 and the anti-blowup piston 126 may be arranged generally uphole from the downhole tool 122 along the length of the tool string 112. However, those skilled in the art will readily appreciate that various alternative configurations and relative arrangements of the downhole tool 122, the air shock tool 124, and the anti-blowup piston 126 may be used, without departing from the scope of the disclosure.

Even though FIG. 1 depicts the tool string 112 as being extended into a substantially vertical portion of the wellbore 108, it will be appreciated by those skilled in the art that the embodiments disclosed herein are equally well suited for use in horizontal wellbores, deviated wellbores, slanted wellbores, diagonal wellbores, combinations thereof, and the like. Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface 106 of the well and the downhole direction being toward the toe of the well. Moreover, as used herein, the term "proximal" refers to that portion of the component being referred to that is closest to the wellhead, and the term "distal" refers to the portion of the component that is furthest from the wellhead.

Figure 2A:
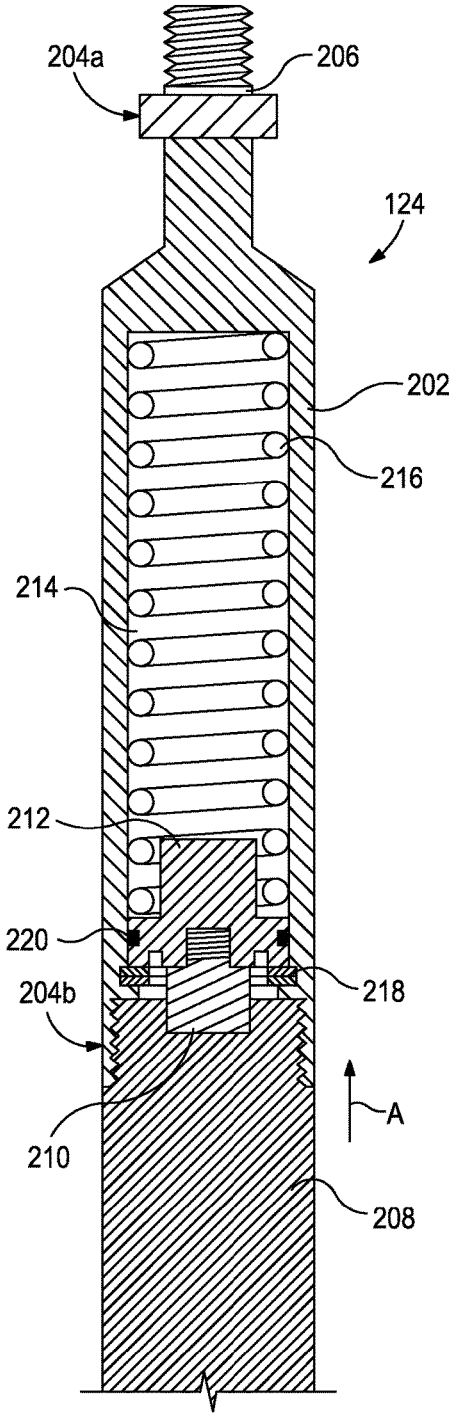
FIG. 2A illustrates an exemplary air shock tool, according to one or more embodiments

Referring now to FIG. 2A, with continued reference to FIG. 1, illustrated is an exemplary embodiment of the air shock tool 124, according to one or more embodiments. As illustrated, the air shock tool 124 may include a housing 202 having a first or proximal end 204*a* and a second or distal end 204*b*. At the proximal end 204*a*, the air shock tool 124 may provide a coupling interface 206 configured to couple the air shock tool 124 to another tool or device in the tool string 112. In at least one embodiment, as described in more detail below, the coupling interface 206 may be operable to couple the air shock tool 124 to the anti-blowup piston 126.

In other embodiments, however, the coupling interface 206 may be configured to couple the air shock tool 124 to any other component of the tool string 112, without departing from the scope of the disclosure. In one embodiment, the coupling interface 206 may be a rope socket, as known to those skilled in the art, and configured to operatively couple the air shock tool to the conveyance 120 of FIG. 1. As depicted, the coupling interface 206 may be a threaded engagement, but may equally be any other type of coupling capable of operably coupling the air shock tool 124 to another component of the tool string 112 or the conveyance 120.

At the distal end 204*b*, the air shock tool 124 may be operatively coupled to a downhole tool 208 that includes or otherwise houses an electronics package 210. As used herein, the term "operatively coupled" can refer to either a direct coupling between two components (e.g., the air shock tool 124 and the downhole tool 208) or an indirect coupling between the two components where another component interposes the two components. In either case, the two components are nonetheless coupled to each other. As illustrated, the downhole tool 208 may be threaded to the distal end 204*b* of the air shock tool 124. In other embodiments, however, the downhole tool 208 may be coupled to the distal end 204*b* of the air shock tool 124 by any means known to those skilled in the art including, but not limited to, mechanical fasteners, shear devices, clamps, combinations thereof, and the like.

The electronics package 210 may include one or more electrical components or a housing configured to contain such electrical components. In operation, the electronics package 210 may be configured to activate or otherwise actuate the downhole tool 208 to perform a wellbore operation. In other embodiments, the electronics package 210 may be configured to facilitate other downhole operations known to those skilled in the art. In any event, the electronics package 210 may include one or more electrical components such as, but not limited to, a timer, a motor, a processor (e.g., a microprocessor, a microcontroller, a digital signal processor, a printed circuit board, a programmable logic device, a controller, discrete hardware components, an artificial neural network, etc.), and a power source (e.g., one or more batteries or fuel cells, a terminal portion of an e-line, etc.) to provide power to the foregoing electrical components.

Upon actuation of a downhole tool arranged downhole from the air shock tool 124 in the tool string 112, a resulting upward acceleration or impact force may result in the uphole direction A. For example, in some embodiments, the impact force may originate from a release tool, such as a smart release tool, configured to separate stuck lower portions of the tool string 112 from upper portions of the tool string 112 such that the upper portions can be returned to the surface 106. Before separation, the tool string 112 may have a large amount of tensile stress applied thereto via the conveyance 120. Upon separation, the upper portions of the tool string 112, including the downhole tool 208 and the air shock tool 124, may rapidly accelerate in the uphole direction A as the built up tensile stress in the conveyance 120 is alleviated.

In other embodiments, the impact force may originate from a jarring tool or an impact generator configured to provide a high impact force to a downhole obstruction within the wellbore 108. Upon delivering the high impact force, a large rebound force may propagate through the tool string 112, thereby rapidly accelerating the downhole tool 208 and the air shock tool 124, including the downhole tool 208 and the air shock tool 124, in the uphole direction A.

As will be appreciated, in some embodiments, the impact force assumed by the air shock tool 124 may originate from the downhole tool 208 of FIG. 2A. In other embodiments, however, the impact force may originate from any other tool or device arranged downhole from the air shock tool 124. Accordingly, in at least one embodiment, the downhole tool 208 may be a smart release tool and in other embodiments, the downhole tool 208 may be a jarring tool or impact generator.

According to the present disclosure, the air shock tool 124 may be configured to minimize any shock impacts delivered or otherwise transferred to the electronics package 210 because of the rapid acceleration of the tool string 112 in the uphole direction A. Barring such protection, the electronics package 210, or one or more electrical components thereof, may be damaged upon sustaining one or more shock impacts. For instance, in some embodiments, the power source (e.g., batteries) of the electronics package 210 may not be anchored securely within the downhole tool 208 and any shock impacts sustained thereto may result in the power source becoming dislodged or non-functional. Likewise, shock impacts sustained by any of the other electrical components of the electronics package 210 may result in permanent damage to such electrical components, thereby requiring a return to the surface 106 (FIG. 1) for repair.

In order to protect the electronics package 210, the air shock tool 124 may include a piston 212 movably arranged within a piston chamber 214 defined in the housing 202. At least one biasing device 216 may also be arranged within the piston chamber 214 and configured to bias the piston 212 in the downhole direction (i.e., opposite the direction A). In some embodiments, the biasing device 216 may be a compression spring, as generally illustrated. In other embodiments, however, the biasing device 216 may be a series of Belleville washers, or the like. One or more lock rings 218 may be arranged within the piston chamber 214 at or near its distal end and configured to secure the piston 212 within the piston chamber 214 and otherwise prevent the piston 212 from extending axially out of the piston chamber 214. The lock ring 218 may be, for example, one or more spiral lock rings and/or one or more snap rings fitted within corresponding grooves defined in the inner wall of the piston chamber 214.

The piston 212 may include one or more seals 220 configured to form a seal against the inner wall of the piston chamber 214 as the piston 212 axially translates therein. In some embodiments, the seal 220 may be an annular O-ring seal or the like. In other embodiments, the seal 220 may be any other type of gasket or seal operable to seal the interface between the piston 212 and the inner wall of the piston chamber 214. The seal 220 substantially seals the piston chamber 214 such that the piston chamber 214 is able to operate similar to a pneumatic shock absorber during its operation. More particularly, when a shock impact is sustained by air shock piston 126, the piston 212 is forced in the uphole direction A and the sealed piston chamber 214 may act like a spring as the air pressure within the piston chamber 214 builds to resist the force applied thereto.

When the downhole tool 208 is properly coupled to the air shock tool 124 at its distal end 204*b*, the electronics package 210 may be forced into operable engagement with the piston 212 such that axial movement of the electronics package 210 correspondingly moves the piston 212. As used herein, the term "operable engagement" or "operatively engaged" can refer to either a direct engagement between two components (e.g., the piston 212 and the electronics package 210) or an indirect coupling between the two components where another component interposes the two components.

In some embodiments, for example, the electronics package 210 may be forced into direct contact with the piston 212 as the downhole tool 208 is coupled (e.g., threaded) to the air shock tool 124. In such embodiments, the electronics package 210 may engage and force or otherwise move the piston 212 within the piston chamber 214 a short distance as the downhole tool 208 is being coupled to the distal end 204*b* of the air shock tool 124. Such engagement may slightly compress the biasing device 216 within the piston chamber 214 and result in compliant engagement.

Figure 2B:
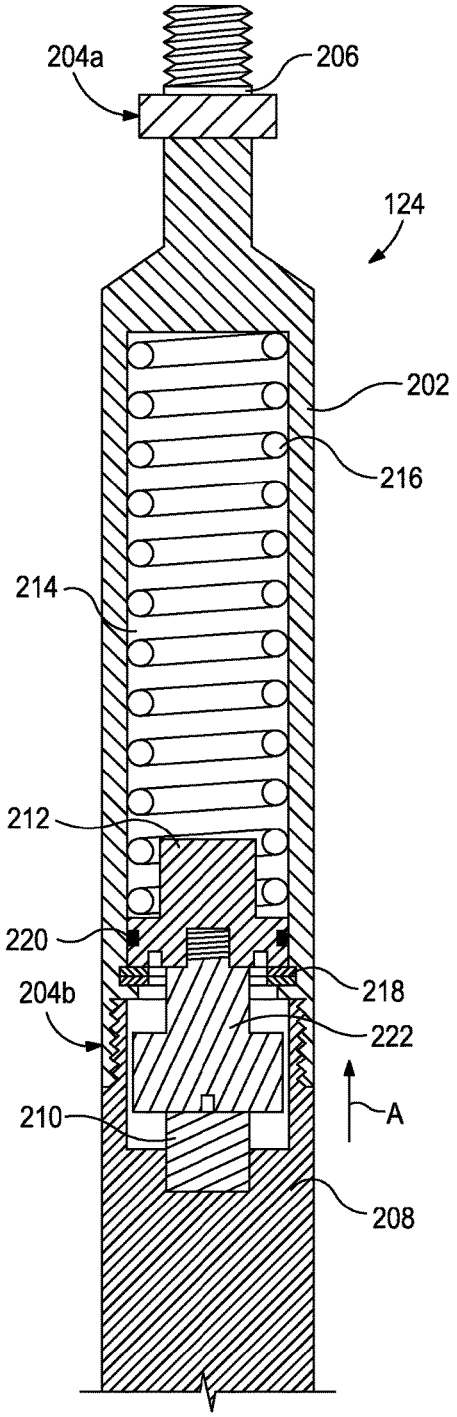
FIG. 2B illustrates the air shock tool of FIG. 2A with a piston extension, according to one or more embodiments.

In other embodiments, as illustrated in FIG. 2B, a spacer or piston extension 222 may generally interpose the piston 212 and the electronics package 210. The piston extension 222 may be coupled to the piston 212 and extend axially therefrom in order to directly engage the electronics package 210. In some embodiments, the piston extension 222 may be threaded to the piston 212, as illustrated. In other embodiments, however, the piston extension 222 may be coupled to the distal end of the piston 212 by any means known to those skilled in the art including, but not limited to, mechanical fasteners, shear devices, clamps, combinations thereof, and the like. As with the embodiment of FIG. 2A, the piston extension 222 may help facilitate compliant engagement between the electronics package 210 and the piston 212 such that axial movement of the electronics package 210 correspondingly moves the piston 212.

While the piston extension 222 is depicted in FIG. 2B as having a particular geometry and axial length, those skilled in the art will readily appreciate that the piston extension 222 may exhibit any geometry and encompass any axial length required to operably engage the piston 212 to the electronics package 210.

In exemplary operation of the air shock tool 124, a shock impact or rapid acceleration force may be sustained by the tool string 112 and propagate through the downhole tool 208 and the electronics package 210 in the uphole direction A. The severity of the shock impact suffered by the electronics package 210 may be minimized through its interaction with the air shock tool 124. For instance, the shock impact assumed by the electronics package 210 may be transferred to the piston 212 and the biasing device 216 via its operable engagement therewith. The piston 212 and the biasing device 216 may generally absorb the shock impact and the sealed piston chamber 214 may act as a pneumatic shock absorber configured to slow axial translation of the electronics package 210. As a result, the electronics package 210 may be generally protected from rapid accelerating forces that would otherwise damage its internal electrical components.

Figure 3A:
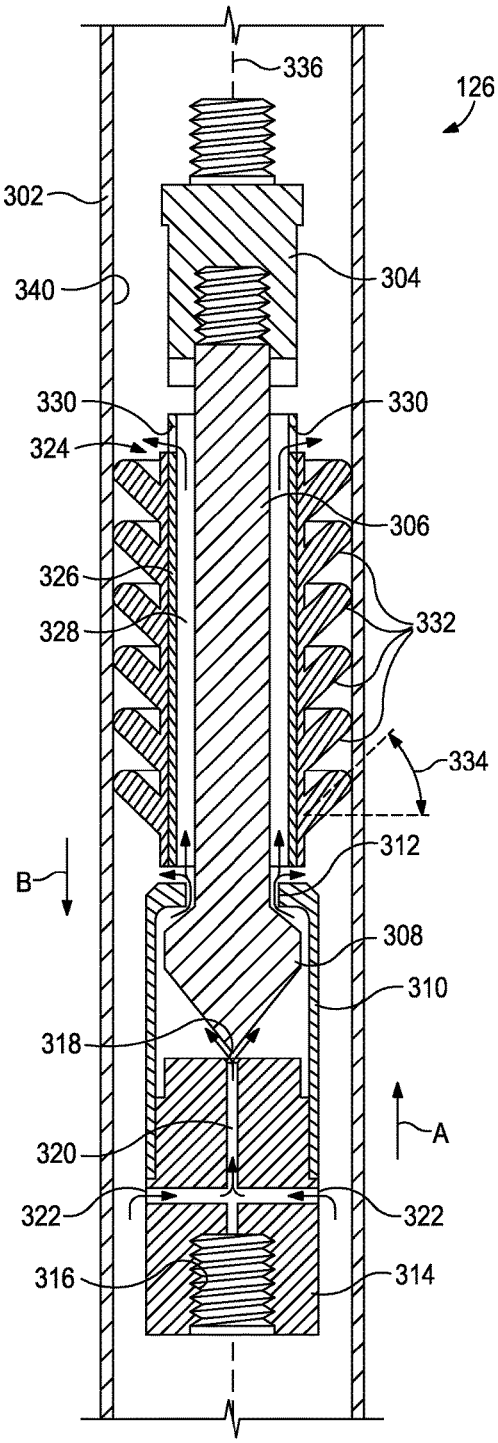
FIGS. 3A and 3B illustrate an exemplary anti-blowup piston, according to one or more embodiments.
Figure 3B:
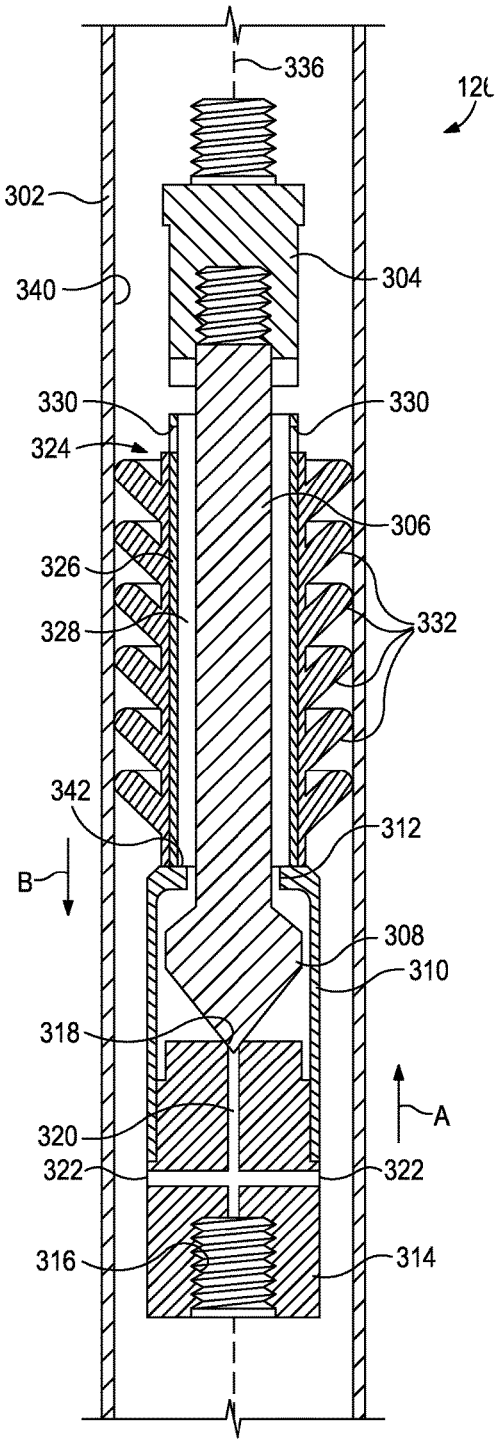

Referring now to FIGS. 3A and 3B, with continued reference to FIG. 1, illustrated is an exemplary embodiment of the anti-blowup piston 126, according to one or more embodiments. As illustrated, the anti-blowup piston 126 may be generally arranged within an elongate tubular 302 in order for it to properly operate. In some embodiments, the tubular 302 may be a casing string cemented into the walls of the wellbore 108 (FIG. 1). In other embodiments, the tubular 302 may be, but is not limited to, production tubing, coil tubing, drill pipe, wellbore liner, and other segmented or continuous tubing lengths. In any event, the tubular 302 may be a downhole conduit into which the tool string 112, including the anti-blowup piston 126, may be introduced to undertake one or more wellbore operations.

The anti-blowup piston 126 may include a top sub 304 operatively coupled to a dart 306 that extends longitudinally therefrom. As illustrated, the dart 306 may be threadably engaged to the top sub 304, but may equally be coupled thereto by any other attachment means known to those skilled in the art. The top sub 304 may be configured to couple the anti-blowup piston 126 to either the conveyance 120 (FIG. 1) or another portion of the tool string 112. The dart 306 may define a head 308 at its distal end, and the head 308 may be movably arranged within a housing 310. More specifically, the housing 310 may define a hole 312 through which a portion of the dart 306 is extended, and the head 310 may exhibit a diameter greater than the hole 312 such that it is prevented from escaping the housing 310 through the hole 312.

The anti-blowup piston 126 may further include a bottom sub 314 threadably coupled to the housing 310 and otherwise providing a means for coupling the anti-blowup piston 126 to another portion of the tool string 112 (FIG. 1). In some embodiments, for example, the bottom sub 314 may be configured to couple the anti-blowup piston 126 to the air shock tool 124 of FIGS. 2A and 2B. To accomplish this, the bottom sub 314 may define a threaded orifice 316 configured to receive the correspondingly threaded coupling interface 206 (FIGS. 2A and 2B) of the air shock tool 124. In other embodiments, however, the bottom sub 314 may be configured to couple the anti-blowup piston 126 to the downhole tool of FIGS. 2A-2B, a release tool, a jarring tool, or any other downhole tool that may be arranged in the tool string 112 (FIG. 1).

The bottom sub 314 may define a seat 318 configured to receive and seat the head 308 of the dart 306 during operation. More particularly, the seat 318 may define a beveled surface configured to matingly engage and otherwise receive a correspondingly beveled outer surface of the head 308 when the head 308 advances axially within the housing 310, as described in more detail below. A central conduit 320 may extend longitudinally from the seat 318 and may be in fluid communication with one or more radially extending ports 322 (two shown) defined in the bottom sub 314. When the head 308 is not matingly engaged with the seat 318, the ports 322 may provide or otherwise facilitate fluid communication between the interior of the tubular 302 and the interior of the housing 310. Fluid communication through the ports 322 and the central conduit 320 may also serve to maintain hydraulic equilibrium within the housing 310.

The anti-blowup piston 126 may further include a mandrel 324 generally interposing the top sub 304 and the housing 310 and at least partially sheathing or otherwise enveloping the dart 306. The mandrel 324 may include an elongate, cylindrical body 326 configured to loosely receive the dart 306 therein. The inner diameter of the body 326 may be greater than the outer diameter of the dart 306 such that an annulus 328 may be defined therebetween and the mandrel 324 is otherwise able to float freely along the axial length of the dart 306 between the top sub 304 and the housing 310. In at least one embodiment, the annulus 328 may be large enough to facilitate fluid communication therethrough. The body may further define one or more perforations 330 (two shown) at a proximal end thereof. The perforations 330 may be configured to allow fluid flow therethrough during operation of the anti-blowup piston 126.

A plurality of ribs or fins 332 may be coupled to or otherwise extend from the body 326. As illustrated, the fins 332 may extend generally in a radial direction from the body 326. In some embodiments, the fins 332 may extend radially from the body at an angle 334 orthogonal to a central axis 336 of the anti-blowup piston 126. The angle 334 may be about 5°, about 10°, about 20°, about 30°, about 45°, about 60°, or any angle falling therebetween from orthogonal to the central axis 336. As will be described below, the angle 334 of the fins 332 may prove useful in generally allowing fluids present within the tubular 302 to bypass the fins 332 as the anti-blowup piston 126 is conveyed in the downhole direction B through the tubular 302.

The fins 332 may be made of a flexible material such as, but not limited to, elastomers, plastics and other flexible polymers, thin metals, pliant composite materials, combinations thereof, and the like. Moreover, the fins 332 may be formed to a particular configuration or design in order to facilitate fluid flow around the fins 332 when the anti-blowup piston 126 is conveyed in the downhole direction B through the tubular 302 and generally inhibit fluid flow around the fins 332 when it is pulled back in the uphole direction A. In some embodiments, the shape of the fins 332 may generally form a plurality of corresponding cups that face the uphole direction A and thereby are able to trap fluid therein when the anti-blowup piston 126 is advanced in the uphole direction A.

Similar to the air shock tool 124 of FIGS. 2A-2B, the anti-blowup piston 126 may prove useful in minimizing shock impacts delivered through operation of the tool string 112 (FIG. 1). Accordingly, in at least one embodiment, the anti-blowup piston 126 may cooperatively function or operate with the air shock 124 in order to minimize the adverse effects of rapid acceleration on any electronics packages 210 (FIGS. 2A-2B) that may be present in the tool string 112 (FIG. 1). In other embodiments, however, the anti-blowup piston 126 may be configured to operate exclusive of the air shock tool 124 to prevent damage to the electronics package 210, without departing from the scope of the disclosure.

In exemplary operation, the anti-blowup piston 126 may be conveyed into the wellbore 108 (FIG. 1) within the tubular 302 (e.g., a casing string) in the downhole direction B. As it advances through the interior of the tubular 302, the anti-blowup piston 126 may be in a generally relaxed state, as depicted in FIG. 3A. In its relaxed state, the fins 332 may lightly engage or otherwise come into close contact with the inner wall 340 of the tubular 302. The upwardly extending angle 334 of the fins 332 may flex and otherwise allow any fluids present within the tubular 302 to flow around the fins 332 as the anti-blowup piston 126 proceeds downhole.

Alternatively, or in addition thereto, fluids present within the tubular 302 may also flow through portions of the anti-blowup piston 126 during its descent. For example, fluids may flow through the ports 322 defined in the bottom sub 314, into the central conduit 320, and into the interior of the housing 310, as generally depicted by the arrows in FIG. 3A. Once in the housing 310, the fluid may be able to flow around the head 308 of the dart 306 and exit the housing 310 through the hole 312. In some cases, the fluid may also be able to flow through the annulus 328 defined between the dart 306 and the body 326 of the mandrel 324. In some cases, fluid pressure against the fins 332 in the uphole direction A may move the mandrel 324 into engagement with the top sub 304. In such cases, any fluid flowing within the annulus 328 may nonetheless escape the annulus 328 via the perforations 330 defined in the body 326, as indicated by the arrows in FIG. 3A. As will be appreciated, having fluid flow around and through the anti-blowup piston 126 as it advances in the direction B may prove advantageous in maintaining hydraulic equilibrium about the anti-blowup piston 126, thereby allowing it to proceed downhole relatively unhindered.

Once reaching its target location within the tubular 302, the tool string 112 (FIG. 1) may undertake the planned wellbore operation(s). In the event one of the wellbore operations results in a shock impact or acceleration force propagating through the tool string 112 in the uphole direction A, the anti-blowup piston 126 may assume such a shock impact and minimize its effects on any electronics packages 210 (FIGS. 2A-2B) present within the tool string 112. More specifically, and with reference to FIG. 3B, when a shock impact is sustained in the uphole direction A, the housing 310 may be correspondingly moved in the uphole direction A as coupled to the bottom sub 314. Moving the housing 310 in the uphole direction A may cause the mandrel 324 to come into contact with the proximal end 342 of the housing 310 and the head 308 of the dart 306 may advance to seat itself within the seat 318. With the mandrel 324 in contact with the proximal end 342 of the housing 310, fluid flow through the annulus 328 may be effectively terminated. Moreover, with the head 308 matingly engaged with the seat 318, fluid flow through the ports 322 and the central conduit 320 may also be effectively terminated.

With the mandrel 324 in contact with the proximal end 342 of the housing 310, rapid acceleration of the anti-blowup piston 126 in the uphole direction A may also cause the upwardly extending fins 332 move in the uphole direction A. As the fins 332 move in the uphole direction A, fluids present within the tubular 302 may become trapped within the fins 332 and thereby force the fins 332 to swell outward and into an increasingly rigid engagement with the inner wall 340 of the tubular 302. As they are forced into engagement with the inner wall 340, the fins 332 may create a fluid seal along the inner wall 340, thereby substantially preventing fluid flow around the fins 332 and otherwise slowing the axial ascent of the anti-blowup piston 126. While a relatively small amount of fluid may bypass the fins 332 as the anti-blowup piston 126 advances upward, the majority is trapped and otherwise forces the anti-blowup piston 126 to act as a hydraulic brake on the tool string 112 as a whole. As a result, any electronics packages 210 (FIGS. 2A-2B) associated with the tool string 112 may be generally protected from rapid accelerating forces that could otherwise damage its internal electrical components.

Embodiments disclosed herein include:

A. A tool string that includes at least one downhole tool having an electronics package associated therewith, and an air shock tool having a housing operatively coupled to the at least one downhole tool and having a piston movably arranged within a piston chamber defined in the housing, wherein the electronics package is operatively engaged with the piston such that axial movement of the electronics package correspondingly moves the piston. A shock impact propagates through the tool string in an uphole direction and the piston is configured to reduce an effect of the shock impact on the electronics package.

B. A method of minimizing shock impact is also disclosed. The method may include conveying a tool string into a wellbore, the tool string including at least one downhole tool with an electronics package associated therewith and an air shock tool operatively coupled to the at least one downhole tool, the air shock tool having a housing and a piston movably arranged within a piston chamber defined in the housing. The method may further include receiving with the tool string a shock impact propagating in an uphole direction, the electronics package assuming at least a portion of the shock impact and being operatively engaged with the piston such that axial movement of the electronics package correspondingly moves the piston, and reducing an effect of the shock impact on the electronics package with the piston via its operable engagement with the electronics package.

C. A tool string is disclosed an includes at least one downhole tool having an electronics package associated therewith, and an anti-blow up piston operatively coupled to the at least one downhole tool and having a plurality of radially extending fins, the plurality of radially extending fins being operable to engage and seal against an inner wall of a tubular into which the tool string is conveyed. When a shock impact propagates through the tool string in an uphole direction, the plurality of radially extending fins trap fluids therein and flex outward towards the inner wall, whereby the anti-blowup piston slows an axial ascent of the tool string and thereby reduces an effect of the shock impact on the electronics package.

Each of embodiments A, B, and C may have one or more of the following additional elements in any combination: Element 1: wherein the electronics package includes one or more electrical components selected from the group consisting of a timer, a motor, a processor, and a power source. Element 2: wherein the at least one downhole tool is at least one of a smart release tool and a jarring tool. Element 3: wherein the at least one downhole tool is a first downhole tool, the tool string further comprising a second downhole tool from which the impact force originates. Element 4: wherein the second downhole tool is at least one of a smart release tool and a jarring tool. Element 5: further comprising at least one biasing device arranged within the piston chamber and configured to bias the piston in a downhole direction, whereby the effect of the shock impact on the electronics package is further reduced. Element 6: further comprising a piston extension coupled to the piston and interposing the piston and the electronics package, the piston extension being configured to operatively engage the piston to the electronics package. Element 7: further comprising an anti-blowup piston operatively coupled to the air shock tool and having a plurality of radially extending fins, wherein, when the shock impact propagates through the tool string, the plurality of radially extending fins trap fluids therein and flex outward towards an inner wall of a tubular into which the tool string is conveyed, whereby the anti-blowup piston slows an axial ascent of the tool string and thereby further reduces the effect of the shock impact on the electronics package.

Element 8: wherein receiving with the tool string the shock impact is preceded by generating the shock impact by actuating the at least one downhole tool, the at least one downhole tool being at least one of a smart release tool and a jarring tool. Element 9: wherein the at least one downhole tool is a first downhole tool, and wherein receiving with the tool string the shock impact is preceded by generating the shock impact by actuating a second downhole tool arranged downhole from the air shock tool, the second downhole tool being at least one of a smart release tool and a jarring tool. Element 10: further comprising biasing the piston in a downhole direction with at least one biasing device arranged within the piston chamber, and further reducing the effect of the shock impact on the electronics package with the at least one biasing device. Element 11: wherein the tool string is conveyed in a tubular arranged within the wellbore and further includes an anti-blowup piston operatively coupled to the air shock tool and having plurality of radially extending fins, the method further comprising trapping fluid present within the tubular with the plurality of radially extending fins when the shock impact propagates through the tool string, and flexing the plurality of radially extending fins outward towards an inner wall of the tubular, thereby slowing an axial ascent of the tool string within the tubular and further reducing the effect of the shock impact on the electronics package.

Element 12: wherein the anti-blowup piston further comprises a top sub, a dart operatively coupled to the top sub and extending longitudinally therefrom, the dart providing a head at its distal end, a housing defining a hole through which a portion of the dart is extended, wherein the head is movably arranged within the housing, a bottom sub coupled to the housing and defining a seat configured to receive and seat the head of the dart, and a mandrel interposing the top sub and having a cylindrical body configured to receive at least a portion of the dart, wherein the plurality of radially extending fins extend from the cylindrical body. Element 13: wherein the anti-blowup piston further comprises a central conduit extending longitudinally from the seat, and one or more radially extending ports defined in the bottom sub and in fluid communication with the central conduit, the one or more radially extending ports and the central conduit being configured to maintain hydraulic equilibrium within the housing. Element 14: wherein the bottom sub couples the anti-blowup piston to an air shock tool, the air shock tool comprising a piston movably arranged within a piston chamber and being operatively engaged with the electronics package such that axial movement of the electronics package correspondingly moves the piston, and at least one biasing device arranged within the piston chamber and configured to bias the piston in a downhole direction, wherein the effect of the shock impact on the electronics package is further reduced through engagement with the piston and the at least one biasing device. Element 15: further comprising a piston extension coupled to the piston and interposing the piston and the electronics package, the piston extension being configured to operatively engage the piston to the electronics package. Element 16: wherein the electronics package includes one or more electrical components selected from the group consisting of a timer, a motor, a processor, and a power source. Element 17: wherein the at least one downhole tool is at least one of a smart release tool and a jarring tool. Element 18: wherein the at least one downhole tool is a first downhole tool, the tool string further comprising a second downhole tool arranged downhole from the anti-blowup piston from which the impact force originates, the second downhole tool being at least one of a smart release tool and a jarring tool.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A tool string, comprising:

at least one downhole tool having an electronics package associated therewith; and an air shock tool having a housing operatively coupled to the at least one downhole tool and a piston movably arranged within a piston chamber defined in the housing, the piston having a solid body that seals the piston chamber, wherein the electronics package is operatively engaged with the piston such that axial movement of the electronics package correspondingly moves the piston, and wherein a shock impact propagates through the tool string in an uphole direction and the piston is biased to reduce an effect of the shock impact on the electronics package.

2. The tool string of claim 1, wherein the electronics package includes one or more electrical components selected from the group consisting of a timer, a motor, a processor, and a power source.

3. The tool string of claim 1, wherein the at least one downhole tool is at least one of a release tool and a jarring tool.

4. The tool string of claim 1, wherein the at least one downhole tool is a first downhole tool, the tool string further comprising a second downhole tool from which the impact force originates.

5. The tool string of claim 4, wherein the second downhole tool is at least one of a release tool and a jarring tool.

6. The tool string of claim 1, further comprising at least one biasing device arranged within the piston chamber and configured to bias the piston in a downhole direction, whereby the effect of the shock impact on the electronics package is further reduced.

7. The tool string of claim 1, further comprising a piston extension coupled to the piston and interposing the piston and the electronics package, the piston extension being configured to operatively engage the piston to the electronics package.

8. The tool string of claim 1, further comprising an anti-blowup piston operatively coupled to the air shock tool and having a plurality of radially extending fins, wherein, when the shock impact propagates through the tool string, the plurality of radially extending fins trap fluids therein and flex outward towards an inner wall of a tubular into which the tool string is conveyed, whereby the anti-blowup piston slows an axial ascent of the tool string and thereby further reduces the effect of the shock impact on the electronics package.

9. A method of minimizing shock impact, comprising:

conveying a tool string into a wellbore, the tool string including at least one downhole tool with an electronics package associated therewith and an air shock tool operatively coupled to the at least one downhole tool, the air shock tool having a housing and a piston movably arranged within a piston chamber defined in the housing, wherein the piston has a solid body that seals the piston chamber;

receiving with the tool string a shock impact propagating in an uphole direction, the electronics package assuming at least a portion of the shock impact and being operatively engaged with the piston such that axial movement of the electronics package correspondingly moves the piston; and reducing an effect of the shock impact on the electronics package with the piston via biased operable engagement of the piston with the electronics package.

10. The method of claim 9, wherein receiving with the tool string the shock impact is preceded by generating the shock impact by actuating the at least one downhole tool, the at least one downhole tool being at least one of a release tool and a jarring tool.

11. The method of claim 9, wherein the at least one downhole tool is a first downhole tool, and wherein receiving with the tool string the shock impact is preceded by generating the shock impact by actuating a second downhole tool arranged downhole from the air shock tool, the second downhole tool being at least one of a release tool and a jarring tool.

12. The method of claim 9, further comprising:

biasing the piston in a downhole direction with at least one biasing device arranged within the piston chamber; and further reducing the effect of the shock impact on the electronics package with the at least one biasing device.

13. The method of claim 9, wherein the tool string is conveyed in a tubular arranged within the wellbore and further includes an anti-blowup piston operatively coupled to the air shock tool and having a plurality of radially extending fins, the method further comprising:

trapping fluid present within the tubular with the plurality of radially extending fins when the shock impact propagates through the tool string; and flexing the plurality of radially extending fins outward towards an inner wall of the tubular, thereby slowing an axial ascent of the tool string within the tubular and further reducing the effect of the shock impact on the electronics package.

* * * * *